US009514685B2

(12) United States Patent
Yoon et al.

(10) Patent No.: US 9,514,685 B2
(45) Date of Patent: Dec. 6, 2016

(54) DISPLAY DEVICE

(71) Applicant: LG Display Co., Ltd., Seoul (KR)

(72) Inventors: Joong Sun Yoon, Goynag-si (KR); Sung Jin Hong, Goyang-si (KR); Dae Hyun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/581,754

(22) Filed: Dec. 23, 2014

(65) Prior Publication Data

US 2015/0179106 A1 Jun. 25, 2015

(30) Foreign Application Priority Data

Dec. 24, 2013 (KR) ..... 10-2013-0162077

(51) Int. Cl.
*G09G 3/36* (2006.01)
*G09G 3/32* (2016.01)

(52) U.S. Cl.
CPC ..... *G09G 3/3283* (2013.01); *G09G 3/3233* (2013.01); *G09G 3/3291* (2013.01); *G09G 2300/0426* (2013.01); *G09G 2300/0842* (2013.01); *G09G 2310/027* (2013.01); *G09G 2310/0262* (2013.01); *G09G 2320/0204* (2013.01); *G09G 2320/0209* (2013.01); *G09G 2320/0223* (2013.01); *G09G 2320/0233* (2013.01); *G09G 2330/00* (2013.01); *G09G 2330/028* (2013.01)

(58) Field of Classification Search
CPC ..... G09G 3/3233; G09G 3/3258; G09G 2300/0439; G09G 2300/08; G09G 2310/027; G09G 2310/0272; G09G 1/005; G09G 2330/02; G09G 3/30; G09G 3/3208; G09G 3/3225; G09G 3/3241; G09G 3/3275; G09G 3/3283; G09G 3/3291
USPC ..... 345/36, 45, 58, 76, 211, 690, 98–100, 345/204; 315/169.3
See application file for complete search history.

(56) References Cited

U.S. PATENT DOCUMENTS

2002/0011976 A1 1/2002 Hashimoto
2006/0022969 A1* 2/2006 Lee ..... G02F 1/136286 345/211
2011/0241563 A1 10/2011 Kim et al.
2012/0235972 A1* 9/2012 Liu ..... G09G 3/3233 345/211

FOREIGN PATENT DOCUMENTS

KR 10-0846591 B1 6/2008
KR 10-0846790 B1 7/2008
KR 10-2009-0046983 A 5/2009
KR 10-2010-0047505 A 5/2010
KR 10-2011-0057534 A 6/2011
KR 10-1073226 B1 10/2011
KR 10-2012-0042084 A 5/2012

(Continued)

*Primary Examiner* — Jennifer Nguyen
(74) *Attorney, Agent, or Firm* — Fenwick & West LLP

(57) ABSTRACT

A display device that may minimize voltage drop of a power source supplied to a pixel is disclosed. The display device comprises a power generator generating a driving power source; a display panel including a plurality of pixels, the display panel displaying images using the driving power source; and a printed circuit board having a power transfer line for transferring the driving power source output from the power generator to the display panel, wherein the power transfer line is provided in a closed-loop type.

19 Claims, 5 Drawing Sheets

(56) References Cited

FOREIGN PATENT DOCUMENTS

| | | | |
|---|---|---|---|
| KR | 10-2012-0045252 | A | 5/2012 |
| KR | 10-2012-0069481 | A | 6/2012 |
| KR | 10-2012-0075828 | A | 7/2012 |
| KR | 10-2012-0076215 | A | 7/2012 |
| KR | 10-2013-0066449 | A | 6/2013 |
| KR | 10-2013-0066450 | A | 6/2013 |
| KR | 10-2013-0074147 | A | 7/2013 |

* cited by examiner

DISPLAY DEVICE

CROSS REFERENCE TO RELATED APPLICATIONS

This application claims the benefit of the Korean Patent Application No. 10-2013-0162077 filed on Dec. 24, 2013, which is hereby incorporated by reference for all purposes as if fully set forth herein.

BACKGROUND OF THE INVENTION

Field of the Invention

The present invention relates to a display device, and more particularly, to a display device that may minimize voltage drop of a power source supplied to a pixel.

Discussion of the Related Art

Recently, with the development of multimedia, importance of flat panel display devices has been increased. In response to this trend, flat panel display devices such as liquid crystal display devices, plasma display devices and organic light emitting display devices have been commercialized. Of the flat panel display devices, the organic light emitting display device has received much attention as a flat panel display device for next generation owning to advantages of fast response speed, low power consumption, and excellent viewing angle characteristic based on self-light emission.

A related art organic light emitting display device includes a display panel, which includes a plurality of pixels formed in a pixel region defined by crossing between a plurality of data lines and a plurality of gate lines, and a panel driver emitting light from each pixel.

Each pixel of the display panel, as shown in FIG. 1, includes an organic light emitting device OLED and a pixel circuit PC.

The pixel circuit PC includes a switching transistor Tsw, a driving transistor Tdr, and a capacitor Cst.

The switching transistor Tsw is switched in accordance with a scan pulse SP supplied to a scan control line SL, and supplies a data voltage Vdata, which is supplied to a data line DL, to the driving transistor Tdr.

The driving transistor Tdr is switched in accordance with the data voltage Vdata supplied from the switching transistor Tsw and controls a data current Ioled flowing to the organic light emitting device OLED by using a driving power source VDD.

The capacitor Cst is connected between gate and source terminals of the driving transistor Tdr, and stores a voltage corresponding to the data voltage Vdata supplied to the gate terminal of the driving transistor Tdr and turns on the driving transistor Tdr at the stored voltage.

The organic light emitting device OLED is electrically connected between a source terminal of the driving transistor Tdr and a common voltage line Vss and emits light through the data current Ioled supplied from the driving transistor Tdr.

Each pixel P of the aforementioned related art organic light emitting display device controls a size of the data current Ioled flowing in the organic light emitting device OLED by using switching of the driving transistor Tdr based on the data voltage Vdata, thereby displaying a predetermined image.

In the aforementioned related art organic light emitting display device, light-emission luminance of each pixel is affected even by the driving power source VDD together with the data voltage Vdata. Accordingly, a uniform voltage of the driving power source VDD should be supplied to each pixel to obtain uniform luminance of each pixel.

However, the driving power source VDD is a current power source having a set voltage level, and according to the related art organic light emitting display device, voltage (IR) drop occurs in the driving power source VDD supplied to each pixel due to line resistance of a driving power line PL. The voltage drop of the driving power source VDD is more increased if the organic light emitting display device has a large area.

FIG. 2 is a diagram illustrating a crosstalk test pattern displayed on a display panel in a related art organic light emitting display device.

If a crosstalk test pattern having a rectangular white pattern on a gray background is displayed as shown in (a) of FIG. 2, in the related art organic light emitting display device, bright line/dark lines A occur in a boundary of the crosstalk test pattern due to voltage drop of the driving power source VDD, whereby vertical crosstalk occurs. The bright line/dark lines A are increased if a size of the crosstalk test pattern is increased.

FIG. 3 is a graph illustrating a current ratio according to a size of a rectangular white pattern in a crosstalk test pattern in a related art organic light emitting display device. In FIG. 3, B is a graph illustrating an ideal current ratio, and C is a graph illustrating a current ratio according to a size of a rectangular white pattern.

If the size of the rectangular white pattern is increased by voltage drop of the driving power source VDD, the current ratio is reduced.

Accordingly, there is a need for a method for reducing the voltage drop of a power source supplied to a pixel.

SUMMARY OF THE INVENTION

Accordingly, the present invention is directed to a display device that substantially alleviates one or more problems due to limitations and disadvantages of the related art.

An advantage of the present invention is to provide a display device that may reduce voltage drop of a power source supplied to a pixel.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objectives and other advantages, as embodied and broadly described herein, a display device comprises a power generator generating a driving power source; a display panel that includes a plurality of pixels and displays images by using the driving power source; and a printed circuit board having a power transfer line for transferring the driving power source output from the power generator to the display panel, wherein the power transfer line is formed in a closed-loop type.

In another aspect, a display device comprises a display panel that includes a plurality of pixels provided in a pixel region defined by crossing between a plurality of scan control lines and a plurality of data lines; a control substrate that includes a power generator generating a driving power source for driving of each pixel; and a printed circuit board connected to the control substrate, having a closed-loop type power transfer line for transferring the driving power source supplied from the power generator to the display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Terminologies disclosed in this specification should be understood as follows.

It is to be understood that the singular expression used in this specification includes the plural expression unless defined differently on the context. The terminologies such as "first" and "second" are intended to identify one element from another element, and it is to be understood that the scope of the present disclosure should not be limited by these terminologies. Also, it is to be understood that the terminologies such as "include" and "has" are not intended to preclude the presence or optional possibility of one or more features, numbers, steps, operations, elements, parts or combination thereof. Furthermore, it is to be understood that the terminology "at least one" is intended to include all combinations that may be suggested from one or more related items. For example, "at least one of a first item, a second item and a third item" means combination of all the items that may be suggested from two or more of the first item, the second item and the third item, as well as each of the first item, the second item and the third item. Also, if it is mentioned that a first element is positioned "on or above" a second element, it should be understood that the first and second elements may be brought into contact with each other, or a third element may be interposed between the first and second elements.

Figure 4:
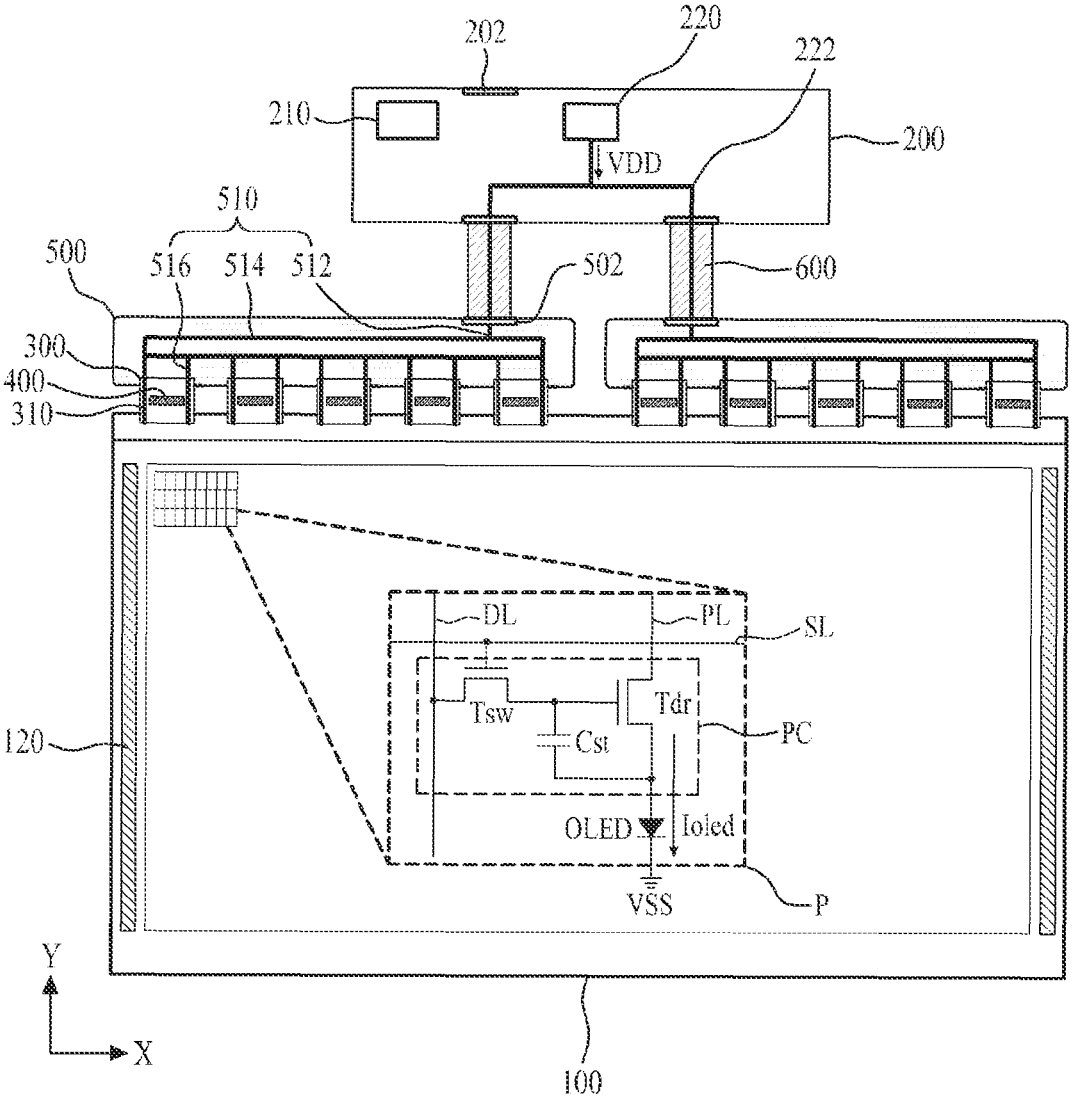
FIG. 4 is a cross-sectional diagram illustrating an organic light emitting display device according to one embodiment.
Figure 5:
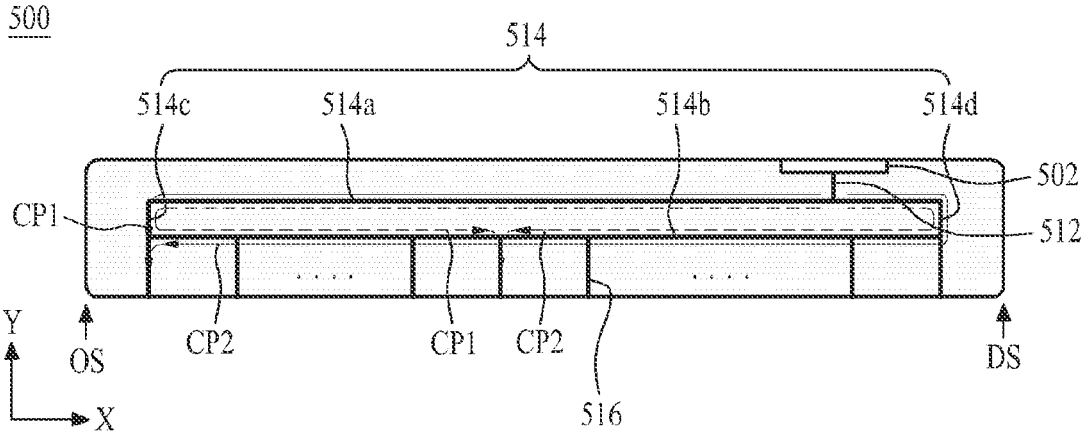
FIG. 5 is a plane diagram illustrating a power supply line according to one example, which is formed on a printed circuit board shown in FIG. 4.

FIG. 4 is a cross-sectional diagram illustrating an organic light emitting display device according to one embodiment, and FIG. 5 is a plane diagram illustrating a power supply line according to one example, which is formed on a printed circuit board shown in FIG. 4.

Referring to FIGS. 4 and 5, an organic light emitting display device includes a display panel 100, a control substrate 200, a plurality of flexible circuit films 300, a plurality of data driving integrated circuits 400, and a printed circuit board 500.

The display panel 100 includes a plurality of pixels P, and signal lines defining a pixel region where each of the plurality of pixels P is formed.

The signal lines may include a plurality scan control lines SL, a plurality of data lines DL, a plurality of driving power lines PL, and a plurality of cathode power lines VSS.

The plurality of scan control lines SL are formed in parallel to have constant intervals along a first direction of the display panel 100, for example, in a horizontal direction. The data lines DL are formed in parallel to have constant intervals along a second direction of the display panel 100, for example, in a vertical direction, thereby crossing the scan control lines. The plurality of driving power lines PL are formed in parallel with the data lines DL. The cathode power lines VSS may be formed on the entire surface of the display panel 100 or may be formed at constant intervals to be parallel with the data lines DL or the scan control lines SL.

Each of the plurality of pixels P includes an organic light emitting device OLED and a pixel circuit PC.

The organic light emitting device OLED emits light in proportion to a data current flowing from the driving power lines PL to the cathode power lines VSS in accordance with driving of the pixel circuit PC. The organic light emitting device OLED includes an anode electrode (not shown), an organic layer (not shown) formed on the anode electrode, and a cathode electrode formed on the organic layer. The organic layer may be formed to have a structure of hole transporting layer/organic light emitting layer/electron transporting layer or a structure of hole injecting layer/hole transporting layer/organic light emitting layer/electron transporting layer/electron injecting layer. Moreover, the organic layer may further include a function layer for improving light emitting efficiency and/or lifespan of an organic light emitting layer. The cathode electrode may be the cathode power line VSS.

Figure 1:
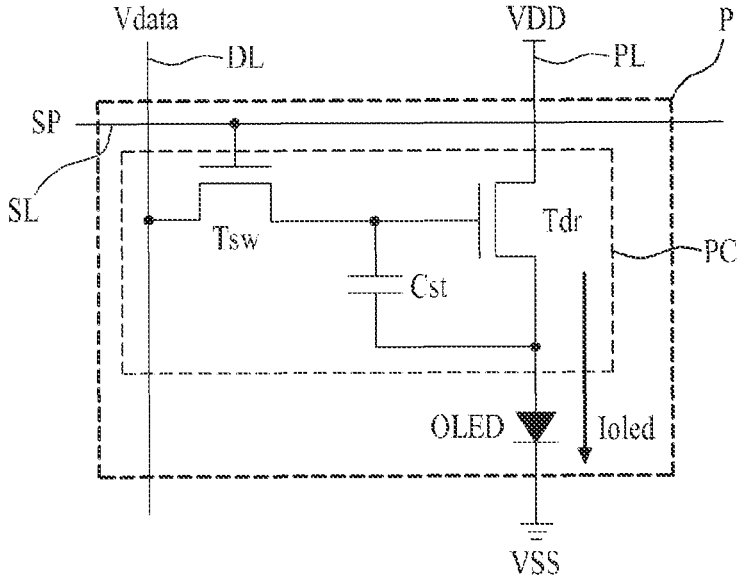
FIG. 1 Related Art
FIG. 1 is a circuit diagram illustrating a pixel structure of a related art organic light emitting display device.
Figure 2:
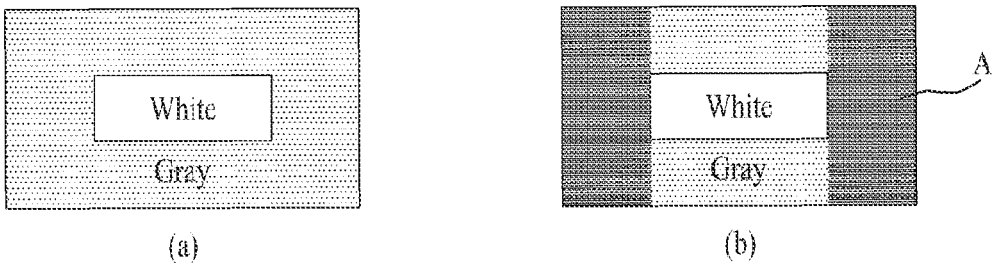
FIG. 2 Related Art
FIG. 2 is a diagram illustrating a crosstalk test pattern displayed on a display panel in a related art organic light emitting display device.
Figure 3:
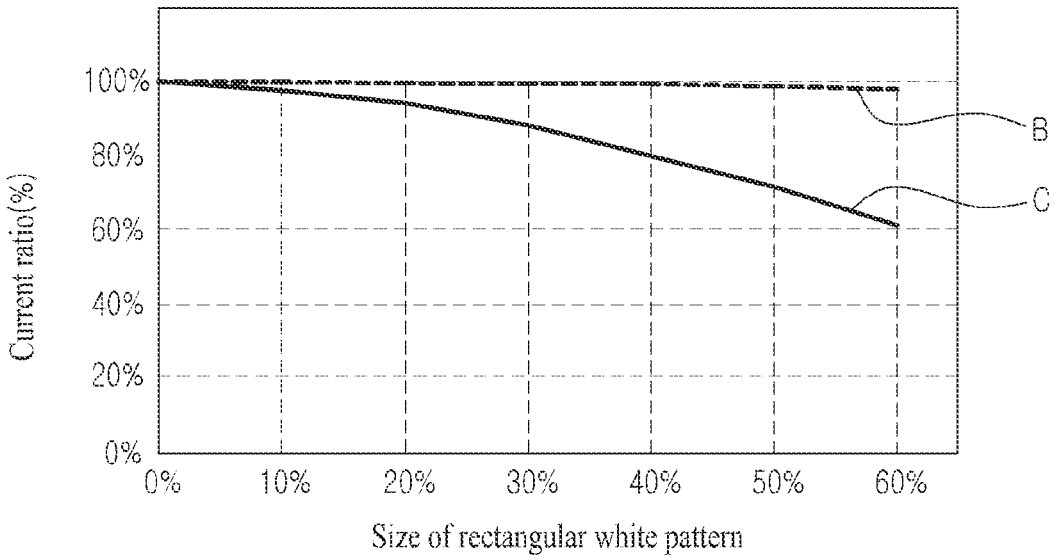
FIG. 3 Related Art
FIG. 3 is a graph illustrating a current ratio according to a size of a rectangular white pattern in a crosstalk test pattern in a related art organic light emitting display device.

The pixel circuit PC controls a current flowing from the driving power line PL to the organic light emitting device OLED in response to the data voltage supplied from the data line DL in accordance with the scan pulse supplied to the scan control line SL. The pixel circuit, according to one example, may include a switching transistor Tsw, a driving transistor Tdr, a capacitor Cst, and an organic light emitting device OLED. Since this pixel circuit PC is the same as that shown in FIG. 1, its repeated description will be omitted.

Additionally, a row driver 120 for driving each of the plurality of scan control lines SL is formed at a non-display area of one side or both sides of the display panel 100. The row driver 120 generates scan pulses in accordance with a scan control signal supplied from the timing controller 210 packaged in the control substrate 200 and sequentially supplies the generated scan pulses to the plurality of scan control lines SL. The row driver 120 is directly formed on a substrate of the display panel 100 together with a process of forming a transistor of each pixel P and then connected to the plurality of scan control lines SL.

The control substrate 200 includes a timing controller 210 and a power generator 220.

The timing controller 210 is packaged in the control substrate 200, receives a timing synchronization signal and image data from an external driving system (not shown) or graphic card (not shown) through a user connector 202, generates pixel data by processing the received image data to be suitable for a pixel arrangement structure of the display panel 100, and supplies the generated pixel data to the corresponding data driving integrated circuit 400. The timing controller 500 generates a scan control signal for controlling the row driver 120 and a data control signal for controlling the plurality of data driving integrated circuits 400 on the basis of a vertical synchronization signal, a horizontal synchronization signal, a data enable signal and a clock signal, which are included in the timing synchronization signal.

The power generator 220 is packaged in the control substrate 200, generates a driving power source required for driving of the pixel P by using an input power source input through the user connector 202, and outputs the generated driving power source to the printed circuit board 500. For example, the power generator 220 may generate a driving power source VDD supplied to the driving transistor Tdr of each pixel P. The power generator 220 generates the driving power source VDD having a set voltage level or generates the driving power source VDD corresponding to driving power data supplied from the timing controller 210. A decompressive direct current-to-direct current converter or a boosting direct current-to-direct current converter may be used as the power generator 220.

Each of the plurality of flexible circuit films 300 is attached to a pad portion provided at a non-display area of an upper side (or lower side) of the display panel 100 and also attached to the printed circuit board 500. Data voltage transmission lines connected to the plurality of data lines one to one through the pad portion are formed in each of the plurality of flexible circuit films 300. Also, driving power transmission lines 310 connected to the plurality of driving power lines one to one through the pad portion are formed in each of the plurality of flexible circuit films 300. The driving power transmission lines 310 may be formed between the respective data voltage transmission lines.

The data driving integrated circuits 400 are packaged in the flexible circuit films 300 one to one. Each of the data driving integrated circuits 400 receives the data control signal and pixel data from the timing controller 210 and converts the pixel data to an analog data voltage in accordance with the data control signal. As a result, the data voltage is supplied to the corresponding data line DL through the data voltage transmission line and the pad portion.

The printed circuit board 500 is connected to the control substrate 200 through a signal transmission member 600. The display device may include at least one printed circuit board 500 in accordance with a size of the display panel 100. The signal transmission member 600 is connected to the printed circuit board 500 one to one. For example, the display device may include two printed circuit boards 500, two signal transmission members 600 and one control substrate 200. Although each of the two signal transmission members 600 may be connected to a center portion in a length direction of the corresponding printed circuit board 500, the size of the control substrate 200 is increased, increasing the cost of the control substrate 200. Accordingly, in order to reduce the size of the control substrate 200, each of the two signal transmission members 600 is slantly connected to an inner side of each of the two printed circuit boards 500 adjacent to a center portion in a horizontal direction of the display panel 100.

The printed circuit board 500 is connected to each of the plurality of flexible circuit films 300. This printed circuit board 500 transfers various signals such as the pixel data, the scan control signal and the data control signal, which are supplied from the timing controller 210, to the corresponding flexible circuit film 300 through the signal transmission member 600. The data transmission line and the control signal transmission line are formed in the printed circuit board 500.

The printed circuit board 500 includes a power transfer line 510 for transferring the driving power source VDD supplied from the power generator 220 to the corresponding flexible circuit 300 or the display panel 100 through the signal transmission member 600.

The power transfer line 510 allows the driving power source VDD to be transferred to the flexible circuit film 300 while uniformly maintaining the voltage level of the driving power source VDD regardless of a transfer distance. The power transfer line 510 may be formed in the printed circuit board 500 in a closed-loop type.

The power transfer line 510 includes an input line 512, a closed-loop line 514, and a plurality of output lines 516.

The input line 512 is connected to a connector 502 packaged in the printed circuit board 500. Accordingly, the driving power source VDD is connected to the input line 512. That is, the driving power source VDD is supplied to the input line 512 by passing through each of a power output line 222 formed in the control substrate 220, the signal transmission member 600 and the connector 502.

The closed-loop line 514 is formed in the printed circuit board 500 to have a closed-loop type and electrically connected to the input line 512. The closed-loop line 514 reduces the voltage drop of the driving power source VDD, which is generated while the driving power source VDD supplied through the input line 512 is being transferred to the plurality of output lines 516. The closed-loop line 514 includes first and second lines 514*a* and 514*b* and first and second connection lines 514*c* and 514*d*, which form a closed-loop.

The first line 514*a* is formed along a first direction X which is a length direction of the printed circuit board 500, and then is connected to the input line 512. Accordingly, the first line 514*a* provides first and second current paths CP1 and CP2 through which the driving power source VDD flows to one side edge OS and the other side edge DS of the printed circuit board 500 on the basis of the input line 512.

The second line 514*b* is formed in parallel with the first line 514*a* to be spaced apart from the first line 514*a* at a certain interval and electrically connected to the plurality of output lines 516. Accordingly, the first line 514*a* provides the first and second current paths CP1 and CP2 to each of the plurality of output lines 516.

The first connection line 514*c* electrically connects ends at one side of each of the first and second lines 514*a* and 514*b* located at one side edge OS of the printed circuit board 500 with each other. Accordingly, the ends at one side of each of the first and second lines 514*a* and 514*b* are connected with each other by the first connection line 514*c* without short.

The second connection line 514*d* electrically connects ends at the other sides of the first and second lines 514*a* and 514*b* located at the other side edge DS of the printed circuit board 500 with each other. Accordingly, the ends at the other sides of the first and second lines 514*a* and 514*b* are connected with each other by the second connection line 514*d* without short.

As a result, the first and second lines 514*a* and 514*b*, which are in parallel with each other, are connected with each other by the first and second connection lines 514*c* and 514*d* without short, thereby forming a closed-loop.

The plurality of output lines 516 are connected to the closed-loop line 514, that is, the second line 514*b* at constant intervals, thereby transferring the driving power source VDD supplied from the closed-loop line 514 to the driving power transmission line 310 of the corresponding flexible circuit film 300. At this time, the driving power source VDD supplied to each of the plurality of output lines 516 maintains a uniform voltage level through the closed-loop line 514. That is, the driving power source VDD is supplied to each of the plurality of output lines 516 through the first and second current paths CP1 and CP2 by passing through each of the first and second connection lines 514*c* and 514*d* on the basis of a connector of the input line 512 and the closed-loop line 514. Accordingly, the driving power source VDD of a uniform voltage level is supplied to each output line 516 regardless of the position from the closed-loop line 514 and the transfer distance.

Although the power transfer line 510 is formed in a rectangular shape on a plane in FIG. 5, the power transfer line 510 may be formed in an oval shape or a rectangular shape of which edge is rounded without being limited to the example of FIG. 5. Alternatively, the power transfer line 510 may be formed in any shape having a closed-loop type.

Figure 6:
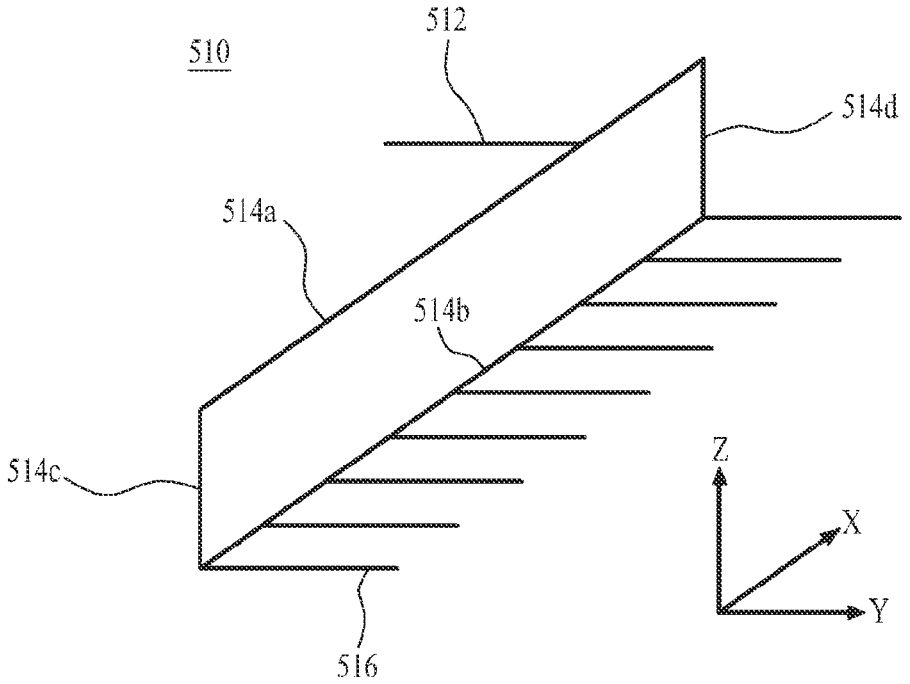
FIG. 6 is a plane diagram illustrating a power supply line according to another example, which is formed on a printed circuit board shown in FIG. 4.

If the printed circuit board 500 has a multi-layered structure, as shown in FIG. 6, the power transfer line 510 may be formed in a rectangular ring shape erected three-dimensionally, that is, vertically, to have the closed-loop type. The first line 514*a* may be formed on the printed circuit board 500 and then connected to the input line 512, and the second line 514*b* may be formed at an inner layer of the printed circuit board 500 to be overlapped with the first line 514*a* in a vertical direction Z which is a thickness direction of the printed circuit board 500, and then may be connected to the plurality of output lines 516. Also, the first connection line 514*c* is formed vertically to pass through the inner layers of the printed circuit board 500 and connects the ends at one side of each of the first and second lines 514*a* and 514*b*, which are formed at different layers while being overlapped with each other, with each other. The second connection line 514*d* is formed vertically to pass through the inner layers of the printed circuit board 500 and connects the ends at the other side of each of the first and second lines 514*a* and 514*b*, which are formed at different layers while being overlapped with each other, with each other. In this case, in order to reduce a voltage drop of the driving power source VDD, the input line 512 is connected to any one of the first and second lines 514*a* and 514*b* and the plurality of output lines 516 are connected to the first line 514*a* or the second line 514*b*, which is not connected to the input line 512.

If the power transfer line 510 is formed three-dimensionally, the size of the printed circuit board 500 may be reduced.

In the aforementioned description, the driving power source VDD output from the power transfer line 510 of the printed circuit board 500 is transferred to the display panel 100 through the flexible circuit film 300. However, the driving power source VDD output from the power transfer line 510 may be transferred to the display panel 100 through a separate signal transmission film (not shown) in which only a signal transmission line is formed, without limitation to the aforementioned description. In this case, the signal transmission film is attached between the pad portion of the display panel 100 and the printed circuit board 500.

Figure 7:
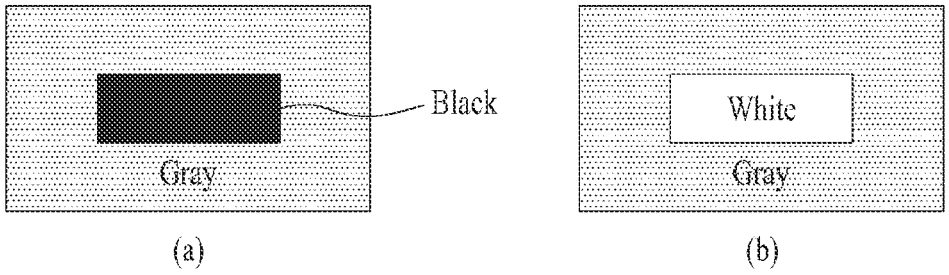
FIG. 7 is a diagram illustrating a crosstalk test pattern displayed on a display panel, according to one embodiment.

FIG. 7 is a diagram illustrating a crosstalk test pattern displayed on a display panel.

First of all, (a) of FIG. 7 illustrates a crosstalk test pattern having a rectangular black pattern on a gray background, which is displayed on the display panel, and it is noted from (a) of FIG. 7 that bright line/dark line are not generated at a boundary of the crosstalk test pattern.

Also, (b) of FIG. 7 illustrates a crosstalk test pattern having a rectangular white pattern on a gray background, which is displayed on the display panel, and it is noted from (b) of FIG. 7 that bright line/dark line are not generated at a boundary of the crosstalk test pattern.

Accordingly, the driving power source VDD is supplied to each pixel P of the display panel 100 through the closed-loop type power transfer line 510 formed in the printed circuit board 500 to minimize voltage drop of the driving power source VDD, whereby picture quality deterioration caused by voltage drop of the driving power source VDD may be reduced or avoided.

Figure 8:
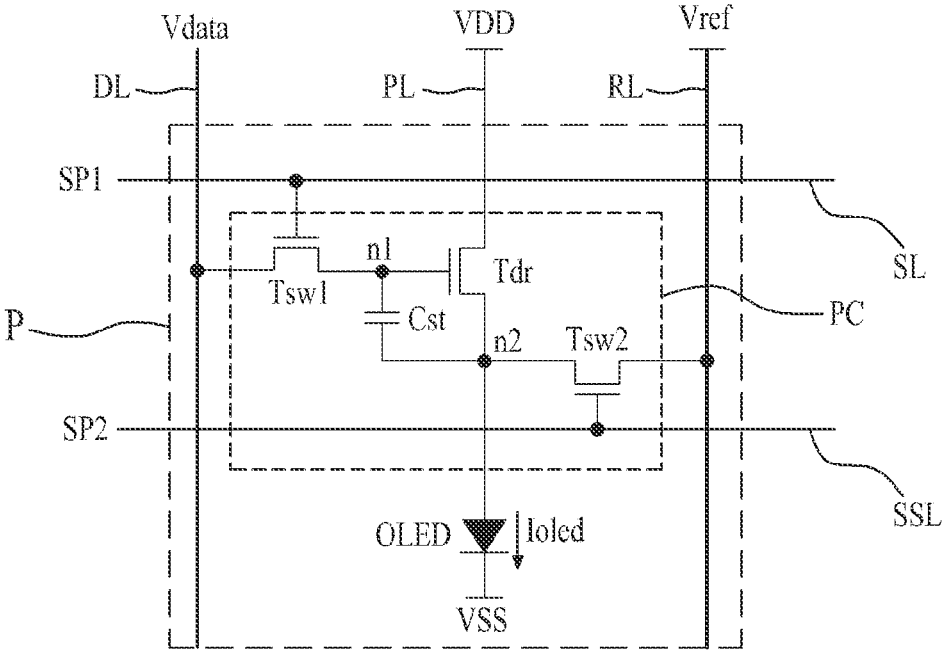
FIG. 8 is a diagram illustrating another example of a pixel shown in FIG. 4.

FIG. 8 is a diagram illustrating another example of a pixel shown in FIG. 4.

Referring to FIG. 4 in association with FIG. 4, each pixel P according to another example may include a pixel circuit PC and an organic light emitting device OLED.

The pixel circuit PC includes a first switching transistor Tsw1, a second switching transistor Tsw2, a driving transistor Tdr, and a capacitor Cst. Each of the transistors Tsw1, Tsw2 and Tdr is a thin film transistor TFT, and may be any one of a-Si TFT, a poly-Si TFT, an Oxide TFT and an Organic TFT.

The first switching transistor Tsw1 is switched in accordance with a first scan pulse SP1 supplied from the row driver 120 to the scan control line SL and outputs the data voltage Vdata supplied to the data line DL. The first switching transistor Tsw1 includes a gate electrode connected to its adjacent scan control line SL, a source electrode connected to its adjacent data line DL, and a drain electrode connected to a first node n1 which is a gate electrode of the driving transistor Tdr.

The second switching transistor Tsw2 is switched in accordance with a second scan pulse SP2 supplied from the row driver 120 to the sensing control line SSL and supplies a reference voltage Vref, which is supplied to a reference line RL, to a second node n2 which is a source electrode of the driving transistor Tdr. The second switching transistor Tsw2 includes a gate electrode connected to its adjacent sensing control line SSL, a source electrode connected to its adjacent reference line RL, and a drain electrode connected to the second node n2. The reference voltage Vref serves to allow the organic light emitting device OLED of each pixel P to be normally operated to emit light, and also serves to initiate a node having a current path within the pixel P.

The capacitor Cst includes first and second electrodes connected between the gate and source electrodes of the driving transistor Tdr, that is, the first and second nodes n1 and n2. The first electrode of the capacitor Cst is connected to the first node n1, and the second electrode of the capacitor Cst is connected to the second node n2. This capacitor Cst charges a difference voltage of voltages supplied to the first and second nodes n1 and n2 in accordance with switching of each of the first and second switching transistors Tsw1 and Tsw2, and then switches the driving transistor Tdr in accordance with the charged voltage.

The driving transistor Tdr is turned on by the voltage of the capacitor Cst and controls the amount of a current flowing from the driving power line PL to the organic light emitting device OLED. The driving transistor Tdr includes a gate electrode connected to the first node n1, a source electrode connected to the second node n2, and a drain electrode connected to the first driving power line PL.

The organic light emitting device OLED emits light through a data current Ioled flowing in accordance with driving of the driving transistor Tdr, thereby emitting single colored light having luminance corresponding to the data current Ioled. The organic light emitting device OLED includes a first electrode (for example, anode electrode) connected to the second node n2, that is, the source electrode of the driving transistor Tdr, an organic layer (not shown) formed on the first electrode, and a second electrode (for example, cathode electrode) connected to the organic layer. The organic layer may be formed to have a structure of hole transporting layer/organic light emitting layer/electron transporting layer or a structure of hole injecting layer/hole transporting layer/organic light emitting layer/electron transporting layer/electron injecting layer. Moreover, the organic layer may further include a function layer for improving light-emitting efficiency and/or lifespan of an organic light emitting layer. The second electrode may be the cathode power line VSS formed on the organic layer, or may additionally be formed on the organic layer, whereby the second electrode may be connected to the cathode power line VSS.

In the aforementioned organic light emitting display device that includes the pixel P according to another example, the reference voltage Vref supplied to the reference line RL may be generated by the power generator 220 shown in FIG. 4. The power generator 220 may generate the reference voltage Vref instead of the aforementioned driving power source VDD. Accordingly, the reference voltage Vref generated by the power generator 220 is supplied to the corresponding reference line RL of the display panel 100 through a power transfer manner that allows the reference voltage Vref to pass through each of the power output line 222 of the control substrate 220, the signal transmission member 600, the connector 502, the power transfer line 510 of the printed circuit board 500, the flexible circuit film 300, and the pad portion.

The power generator 220 may generate the driving power source VDD and the reference voltage Vref and supply the generated driving power source VDD and reference voltage Vref to each pixel P of the display panel 100. In this case, each of the driving power source VDD and the reference voltage Vref is supplied to each pixel P of the display panel 100 in accordance with the aforementioned power transfer manner through a separate line, and a separate power transfer line having the closed-loop type for transfer of each of the driving power source VDD and the reference voltage Vref is formed on the printed circuit board 500.

The second switching transistor Tsw2 and the reference line RL in the pixel P shown in FIG. 8 may be used to sense a characteristic value of the driving transistor Tsw of the corresponding pixel, that is, threshold voltage or mobility. Since such a sensing method is disclosed in the Korean Laid-Open Patent No. 10-2009-0046983, 10-2010-0047505, 10-2011-0057534, 10-2012-0045252, 10-2012-0076215, 10-2013-0066449, 10-2013-0066450 or 10-2013-0074147, or Korean Registered Patent No. 10-0846790 or 10-1073226, its detailed description will be omitted. Also, the pixel of the present invention may reduce voltage drop of the power source, which is supplied to the pixel, such as the reference voltage, even in the case that the pixel of the present disclosure is modified to pixel structures of the above references.

In the organic light emitting display device according to the present disclosure, although the power source generated by the power generator 220 is the driving power source VDD and/or the reference voltage Vref, which is supplied to each pixel P, the power source may equally be applied to an organic light emitting display device having an inner compensation type pixel for internally compensating for a characteristic value of a driving transistor by using a capacitor.

Korean Registered Patent No. 10-0846591 discloses a first power voltage VDD and a second power voltage Vsus, and the Korean Laid-Open Patent Nos. 10-2012-0042084, 10-2012-0069481 and 10-2012-0075828 disclose a reference voltage Vref, as a separate power source used to compensate for variations in the characteristics of the driving transistor in an inner compensation type pixel structure. The device of the present disclosure may supply the second power voltage Vsus and/or the reference voltage Vref (hereinafter, referred to as "compensation power source"), which is disclosed in the above known references of the inner compensation type, to each pixel P through the power transfer line 510 of the closed-loop type, thereby reducing voltage drop of the compensation power source.

As a result, the technical spirits according to the present disclosure may equally be applied to all the pixel structures of the organic light emitting display devices that use the power source, without being limited to the aforementioned power sources. Moreover, the technical spirits according to the present disclosure may equally be applied to all the display devices that use a power line having a current path.

According to the present disclosure, the following advantages may be obtained.

As the driving power source is supplied to the display panel through the closed-loop type power transfer line, voltage drop of the driving power source may be reduced, whereby picture quality deterioration caused by voltage drop of the driving power source may be reduced or avoided.

It will be apparent to those skilled in the art that various modifications and variations can be made in the present invention without departing from the spirit or scope of the inventions. Thus, it is intended that the present disclosure covers the modifications and variations of this invention provided they come within the scope of the appended claims and their equivalents.

What is claimed is:

1. A display device comprising:

a power generator generating a driving power source;

a display panel including a plurality of pixels, the display panel displaying images using the driving power source; and a printed circuit board having a power transfer line for transferring the driving power source output from the power generator to the display panel, wherein the power transfer line is provided in the printed circuit board in a closed-loop type.

2. The display device of claim 1, wherein each pixel has a current path based on the driving power source.

3. The display device of claim 1, wherein the power transfer line includes:

an input line to which the driving power source is supplied from the power generator;

a closed-loop line provided in a closed-loop type and connected to the input line; and a plurality of output lines outputting the driving power source supplied through the closed-loop line to the display panel.

4. The display device of claim 3, wherein the closed-loop line includes:

a first line along a length direction of the printed circuit board and connected to the input line;

a second line in parallel with the first line and connected to the plurality of output lines;

a first connection line connecting ends at one side of each of the first and second lines with each other; and a second connection line connecting ends at another side of each of the first and second lines with each other.

5. The display device of claim 4, wherein, the first line is provided on the printed circuit board, and connected to the input line; and the second line is provided at an inner layer of the printed circuit board to be overlapped with the first line in a vertical direction which is a thickness direction of the printed circuit board, and connected to the plurality of output lines.

6. The display device of claim 5, wherein the first connection line is provided vertically to pass through the inner layers of the printed circuit board and connects the ends at one side of each of the first and second lines.

7. The display device of claim 5, wherein the second connection line is provided vertically to pass through the inner layers of the printed circuit board and connects the ends at other side of each of the first and second lines.

8. A display device comprising:

a display panel that includes a plurality of pixels in a pixel region defined by crossing between a plurality of scan control lines and a plurality of data lines;

a control substrate including a power generator generating a driving power source for driving of each pixel; and a printed circuit board connected to the control substrate, having a closed-loop type power transfer line for transferring the driving power source supplied from the power generator to the display panel, wherein the closed-loop type power transfer line is provided in the printed circuit board in a closed-loop type.

9. The display device of claim 8, wherein each pixel has a current path based on the driving power source.

10. The display device of claim 8, wherein the power transfer line includes:

an input line to which the driving power source is supplied from the power generator;

a closed-loop line provided in a closed-loop type and connected to the input line; and a plurality of output lines outputting the driving power source supplied through the closed-loop line to the display panel.

11. The display device of claim 10, wherein the closed-loop line includes:

a first line along a length direction of the printed circuit board and connected to the input line;

a second line in parallel with the first line and connected to the plurality of output lines;

a first connection line connecting ends at one side of each of the first and second lines with each other; and a second connection line connecting ends at the other side of each of the first and second lines with each other.

12. The display device of claim 11, wherein, the first line is provided on the printed circuit board, and connected to the input line; and the second line is provided at an inner layer of the printed circuit board to be overlapped with the first line in a vertical direction which is a thickness direction of the printed circuit board, and connected to the plurality of output lines.

13. The display device of claim 12, wherein the first connection line is provided vertically to pass through the inner layers of the printed circuit board and connects the ends at one side of each of the first and second lines.

14. The display device of claim 12, wherein the second connection line is provided vertically to pass through the inner layers of the printed circuit board and connects the ends at other side of each of the first and second lines.

15. The display device of claim 10, further comprising a plurality of flexible circuit films connected to the display panel, having transmission lines connected to the output lines provided on the printed circuit board one to one.

16. The display device of claim 15, wherein each of the plurality of pixels includes:

an organic light emitting device; and a pixel circuit having a driving transistor controlling a current flowing from the driving power source to the organic light emitting device in response to a data voltage supplied to the data line.

17. The display device of claim 16, further comprising:

a data driver packaged in each of the plurality of flexible circuit films, supplying the data voltage to a corresponding pixel through the data line; and a driving power line provided in parallel with the data line, supplying the driving power source to the driving transistor.

18. The display device of claim 16, wherein, the pixel circuit further includes a switching transistor supplying a reference voltage, which is supplied to a reference line in parallel with the data line, to a source electrode of the driving transistor, and the power generator additionally generates the reference voltage different from the driving power source, and supplies the reference voltage to the reference line through a separate power transfer line provided on the printed circuit board in a closed-loop type.

19. The display device of claim 15, further comprising:

a data driver packaged in each of the plurality of flexible circuit films, supplying a data voltage to a corresponding pixel through the data line; and a reference line to which the driving power source is supplied, the reference line in parallel with the data line, and each of the plurality of pixels includes:

an organic light emitting device; and a pixel circuit having a driving transistor, which is driven by a difference voltage between the data voltage supplied through the data line and the driving power source supplied through the reference line and controls a current flowing in the organic light emitting device.

* * * * *